United States Patent [19]

Bennett et al.

[11] Patent Number: 4,680,423

[45] Date of Patent: Jul. 14, 1987

[54] HIGH PERFORMANCE FLAT CABLE

[75] Inventors: Glenn E. Bennett, Harrisburg, Pa.; Raymond J. Look, Largo, Fla.; Frank P. Dola, Hudson, Fla.; Richard E. Thurman; Paul P. Siwinski, both of Seminole, Fla.

[73] Assignee: AMP Incorporated, Harrisburg, Pa.

[21] Appl. No.: 707,935

[22] Filed: Mar. 4, 1985

[51] Int. Cl.[4] ..... H01B 7/08; H01B 11/00

[52] U.S. Cl. ..... 174/36; 174/110 F; 174/117 F

[58] Field of Search ..... 174/36, 110 F, 117 F, 174/70 C, 72 C; 333/1

[56] References Cited

U.S. PATENT DOCUMENTS

| | | | |
|---|---|---|---|
| 2,581,472 | 1/1952 | Dudley et al. | 174/117 F |
| 3,219,752 | 11/1965 | Harris | 174/117 R |
| 3,309,458 | 3/1967 | Yoshimura et al. | 174/110 F |
| 3,567,846 | 3/1971 | Brorein et al. | 174/36 X |
| 3,735,022 | 5/1973 | Estep | 174/117 F |
| 3,757,029 | 9/1973 | Marshall | 174/117 F X |
| 3,763,306 | 10/1973 | Marshall | 174/117 F X |
| 3,775,552 | 11/1973 | Schumacher | 174/105 R |
| 4,155,613 | 5/1979 | Brandeau | 339/29 R |
| 4,218,581 | 8/1980 | Suzuki | 174/117 R X |
| 4,220,807 | 9/1980 | Anastasi et al. | 174/117 F X |
| 4,287,385 | 9/1981 | Dombrowsky | 174/117 F X |
| 4,296,457 | 10/1981 | Hahlganss | 174/117 F X |
| 4,404,424 | 9/1983 | King et al. | 174/117 F X |
| 4,419,538 | 12/1983 | Hansell, III | 174/117 F |
| 4,443,657 | 4/1984 | Hill et al. | 174/117 F X |
| 4,468,089 | 8/1984 | Brorein | 174/117 F X |
| 4,481,379 | 11/1984 | Bolick, Jr. et al. | 174/121 A X |
| 4,487,992 | 12/1984 | Tomito | 174/36 |
| 4,488,125 | 12/1984 | Gentry et al. | 174/115 X |
| 4,508,415 | 4/1985 | Bunnell | 339/143 R |

FOREIGN PATENT DOCUMENTS

| | | | |
|---|---|---|---|
| 41097 | 12/1981 | European Pat. Off. | 174/117 F |
| 1085610 | 2/1955 | France | 174/117 R |
| 2519797 | 7/1983 | France | 174/117 F |
| 440596 | 1/1936 | United Kingdom | 174/27 |

*Primary Examiner*—Morris H. Nimmo

*Attorney, Agent, or Firm*—Robert W. Pitts; Eric J. Groen

[57] ABSTRACT

A high performance controlled impedance low loss low attenuation cable having the characteristics of a shielded twisted pair cable is disclosed. The cable contains a plurality of pairs of associated conductors located in a single plane to give a low profile flat cable suitable for use in undercarpet wiring installations. The cable comprises a plurality of layers of extruded insulating material with a metal foil shield surrounding only associated pairs of conductors. Insulating material having different dielectric constants is employed in conjunction with the encircling foil shield to give the cable the characteristics of a conventional shielded twisted pair cable.

18 Claims, 8 Drawing Figures

HIGH PERFORMANCE FLAT CABLE

BACKGROUND OF THE INVENTION

1. Field of the Invention

This invention relates to high performance multiconductor flat cable and more particularly to controlled impedance low loss low attenuation cable employing a plurality of conductor pairs which can be used in undercarpet installations.

2. Description of the Prior Art

Conventional multiconductor cable for transmitting high frequency digital signals includes both shielded twisted pair cable and coaxial cable. Shielded twisted pair cable utilizes a conventional twisted pair configuration and employs a shield around the twisted pair to reduce EMI radiation and to minimize cross talk. Coaxial cables similarly use an EMI shield to reduce radiation and cross talk.

Considerable effort has been extended to develop a flat multiconductor coaxial cable which would yield the same performance as conventional coaxial cable but would also enable the use of conventional mass termination techniques to attach connectors to the cable. For example, U.S. Pat. No. 4,488,125 discloses a flat cable assembly in which a signal conductor and at least one drain conductor are embedded in a first insulating matrix and surrounded by a shield which is in turn surrounded by an outer insulating layer. The drain wires are positioned in contact with the outer layer to enable both the signal and drain wires to be connected by a mass termination process. Other flat coaxial cables are disclosed in U.S. Pat. Nos. 4,487,992 and 3,775,552. One application for flat data cable is the use of this cable in under the carpet wiring situations in which a flat low profile cable is extended beneath a carpet for connection to digital equipment.

Conventional twisted pair cable does not have a profile suited for use in undercarpet applications. The invention disclosed herein comprises a relatively low profile flat cable having the performance characteristics of shielded twisted pair cable but yet having a low profile suited for undercarpet installations. The flat cable disclosed herein also has the mass termination capabilities of flat cable with conductors spaced on repeatable precise center lines, unlike conventional shielded pair cable.

SUMMARY OF THE INVENTION

The preferred embodiments of this invention comprise a controlled impedance, low attenuation, balanced flat cable having the performance characteristics of shielded twisted pair cable and comprising a multilayer extruded cable having an annealed copper shield encapsulating associated pairs of conductors. Each conductor is surrounded by a first insulating material having a lower dielectric constant than a second dielectric material which surrounds each of the two conductors forming an associated pair. The second layer of insulation gives dimensional stability to the conductors comprising the pair and precisely positions the foil shield relative to the conductors. An outer layer of insulating material is extruded over the shields of adjacent conductor pairs and holds the shield in place to prevent radiation. In the preferred embodiment of this invention, the second insulating material is extruded into a generally oval configuration having one planar surface. The metal foil shield is disposed around the second insulating material and the overlapping ends of the metal foils are positioned along the planar end which extends generally perpendicular to the plane of the conductors. Integral wings or ramps are provided on the sides of the central body of the cable to provide a smooth transition with the surface on which the cable is positioned. Weakened sections can be provided between the outer wings and the main body of the cable and weakened sections can also be provided in the second insulating material to permit easy separation of the conductors from the cable to facilitate termination to connectors positioned on the ends of the cable.

BRIEF DESCRIPTION OF THE DRAWINGS

FIG. 8 is a view similar to FIG. 1 showing an alternate embodiment of a flat cable in accordance with this invention.

DESCRIPTION OF THE PREFERRED EMBODIMENTS

The multilayer shielded pair cable comprising the preferred embodiment of this invention provides a controlled high impedance, low cross talk, low attenuation multiconductor flat cable suitable for use in transmitting digital or other high frequency data. The preferred embodiment of this invention will be described in terms of a flat cable having two separate pairs of associated conductors, four conductors in all. It should be understood however that some applications may require cable having more than two pairs of conductors. This invention is consistent with the use of any number of pairs of conductors and can be employed with a single pair of conductors or with a large number of pairs. Indeed this invention is intended for use in applications requiring three pairs of conductors in a manner similar to the use of the two-pair cable which comprises the preferred embodiment of this invention. The principal embodiment of this invention depicted herein is intended for use in installations in which the flat cable is to be installed along the floor of an office building and under the carpet to enable connections to be made with portions of a network arbitrarily distributed in an office building. It should be understood however that this high performance cable, having conductors located within the same plane, is not limited to use in undercarpet installations. Indeed, the constant orientation of the conductors in the same plane renders this cable quite suitable to applications in which it is desirable that the conductors be simultaneously mass terminated to the connector position at the end of the cable. Indeed this cable is quite suitable for use as a predeterminated cable assembly in which connectors may be assembled at each end of precise lengths of cable in a factory environment.

Figure 1:
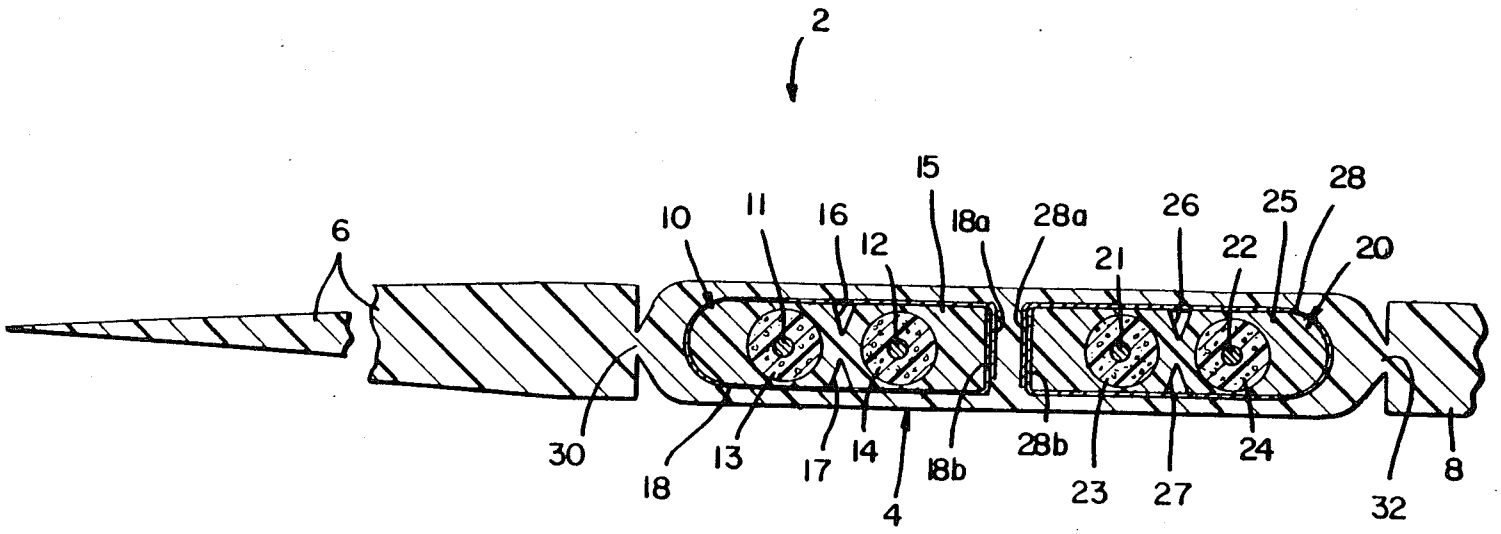
FIG. 1 is a cross-sectional view of a two-pair flat cable especially adapted for use in under-the-carpet installations.

The cross-sectional configuration shown in FIG. 1 demonstrates the relative positioning of four conductors 11, 12, 21 and 22 in a flat cable assembly 2. Each of the conductors 11, 12, 21 and 22 employed in the preferred embodiment of this invention comprises a conventional round wire conductor. Conductors 11 and 12 comprise one associated pair of conductors while conductors 21 and 22 comprise a similar pair of associated conductors. Each of the conductors 11, 12, 21 and 22 are positioned in the same plane, thus facilitating a low profile necessary for use in undercarpet installations. Each conductor pair nevertheless retains the capability for balanced signal transmission. Both of the conductor pairs are embedded in an outer insulating body 4 which comprises the central longitudinally extending portion of the cable 2. Similar wings or ramps 6 and 8 are bonded longitudinally along the opposite sides of the central body 4. Each of the wings 6 and 8 comprises an inclined surface to provide a smooth transition laterally of the axis of the cable, thus eliminating any sharp bump when the cable is positioned beneath a carpet. In the preferred embodiment of this invention, the insulating ramps 6 and 8 are formed from the same material as the insulating material forming insulating body 4. Wings 6 and 8 are joined to body 4 along weakened longitudinally extending sections 30 and 32. In the preferred embodiment of this invention, the insulating material forming the body 4 and the insulating material forming wings 6 and 8 comprises an extruded insulating material having generally the same composition. Conventional polyvinyl chloride insulation comprises one material suitable for use in the jacket or body 4 in the wings 6 and 8.

Figure 2:
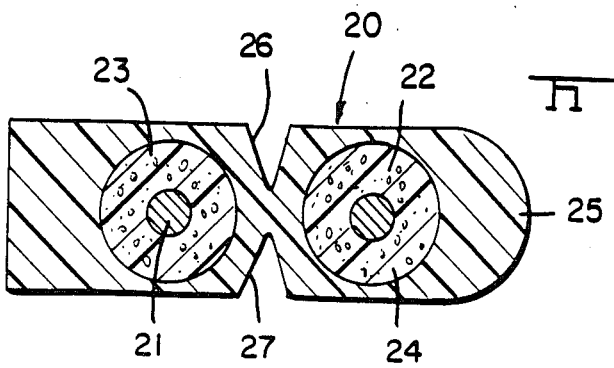
FIG. 2 is a cross-sectional view of a single pair cable embedded in an insulating core surrounding both conductors of an associated pair.

Each shielded cable pair is separately embedded within the insulating body 4. As shown in FIG. 2, the conductors 21 and 22 forming one pair 20 of associated conductors is encapsulated within a separate insulating core 25 which is in turn embedded within the body 4 of the cable 2. Each conductor 21 and 22 is however encircled by a first insulation 23 and 24 respectively which comprises a foam-type insulation having a relatively low dielectric constant. Foam-type insulation such as polypropylene or polyethylene, each of which contain the large percentage of air trapped within the material comprise a suitable dielectric material for use around the conductors in areas of relatively high dielectric field. These foam covered conductors can then be embedded within an insulating material 25 which completely surrounds the foam insulation 23 and 24 in the immediate vicinity of the conductors. The insulating material 25 need not have as low a dielectric constant as the foam insulation 23 and 24, since the insulating material 25 is located in areas of relatively lower electric fields. The insulating material 25 thus has less effect on the cable impedance than the foam insulation 23 and 24. The insulating material 25 must however be suitable for imparting dimensional stability to conductors 21 and 22. In fact in this invention the dielectric material 25 holds the conductors 21 and 22 in a parallel configuration along precisely spaced center lines. The insulating material forming the core 25 also comprises a material having greater strength when subjected to compressive forces than the foam type insulation 23 and 24 surrounding conductors 21 and 22. A material suitable for forming core 25 is a conventional polyvinyl chloride which can be extruded around the foam insulation 23 and 24 surrounding conductors 21 and 22. It is desirable that the foam type insulation 23 and 24 not adhere to the extruded insulating material forming the core 25 since the conductors must be removed from the core 25 for conventional termination into a connector. In the preferred embodiment of this invention, longitudinally extending notches 26 and 27 are defined along the upper and lower surfaces of the core 25. These notches, which can be conveniently formed as part of the extrusion process are located in areas of relatively low dielectric field and define a weakened section of insulating core 25 to permit separation of conductors 21 and 22 for termination purposes.

Figure 3:
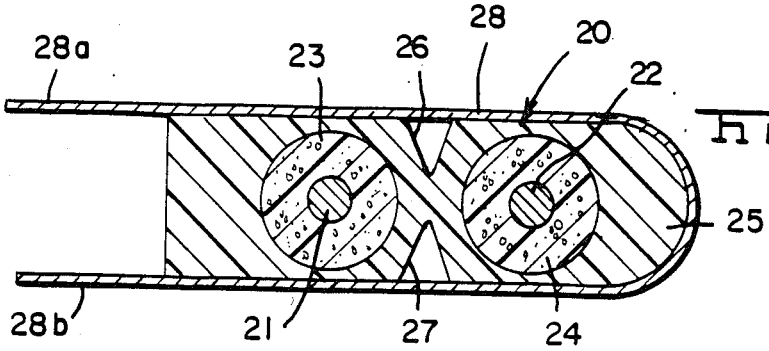
FIG. 3 is a cross-sectional view similar to FIG. 2 demonstrating the positioning of an EMI shield during fabrication of a shielded conductor pair.
Figure 4:
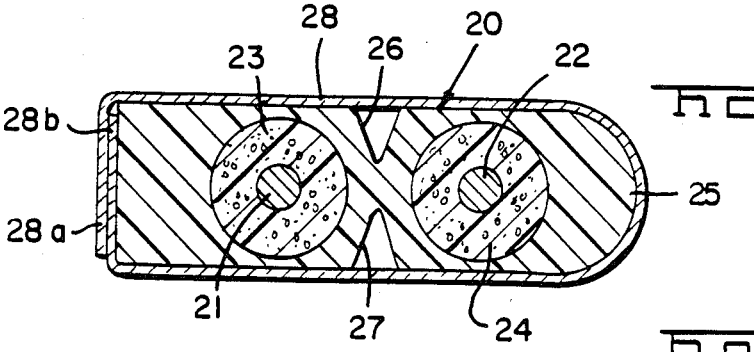
FIG. 4 is a view similar to FIG. 3 demonstrating the final position of the EMI shield encircling both conductors of the conductor pair.
Figure 5:
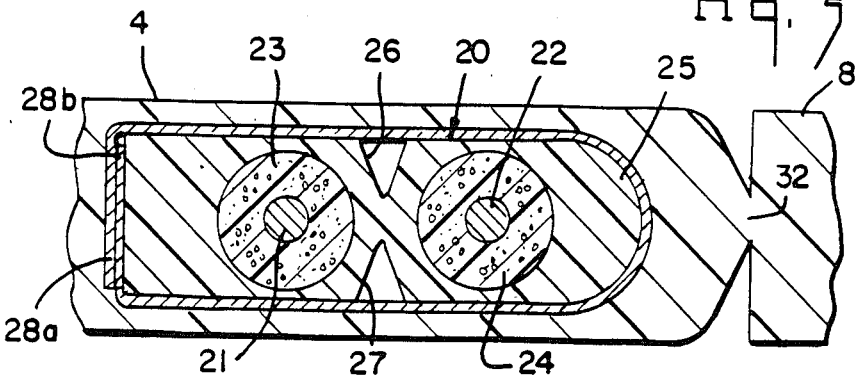
FIG. 5 is a cross-sectional view showing the single conductor pair surrounded by a EMI shield encapsulated within an outer insulating body.

The cross talk and noise performance of each pair of conductors is greatly enhanced by the use of EMI shields 18 and 28 encircling the cores 15 and 25 of the conductors within each conductor pair 10 and 20. As shown in FIG. 3, an EMI shield 28 can be positioned in partially encircling relationship to conductors 21 and 22 within insulating core 25. The ends 28A and 28B of EMI shield extend beyond the lateral edge of core 25 during fabrication of the cable. FIG. 4 shows that these ends 28A and 28B can then be folded into overlapping relationship along one end or edge of the core 25. In the preferred embodiment of this invention, the one edge of core 25 comprises a planar edge extending transversely, and preferably perpendicular to the plane in which the conductors 21 and 22 are positioned. This planar edge facilitates assembly of the shield 28 in overlapping relationship along the edge of core 25. Furthermore by providing sharp corners at the upper and lower extent of this planar surface, good contact is maintained between the overlapped portions 28A and 28B of the cable at these two points. Thus gaps, which can act as an antenna in the shielding are prevented. As shown in FIG. 5, the overlapped ends 28A and 28B of the EMI shield 28 are secured in a tightly held configuration by the insulating material extruded around the EMI shield and comprising the insulating body 4. Thus the ends 28A and 28B would not be subject to movement upon flexure of the cable to create a gap or radiating antenna. In the preferred embodiment of this invention, an annealed metallic foil is employed as the EMI shields 18 and 28. For example, an annealed copper foil having a 2 mil thickness is suitable for use as an EMI shield in the preferred embodiment of this invention.

FIG. 8 shows an alternate embodiment of this invention in which planar ends of the insulating cores, at which the EMI shield is overlapped are positioned on the exterior of the conductor pairs. FIG. 1 shows the two ends of the separate EMI shields positioned adjacent to each other within the body 4. Since the invention is suitable for use with more than two pairs of conductors, it is apparent that the relative positioning of the flat overlapping ends of the cable is a matter of choice. For example if three pairs are employed, the flat ends of all three shields cannot be adjacent if all conductors are positioned within the same plane.

Figure 6:
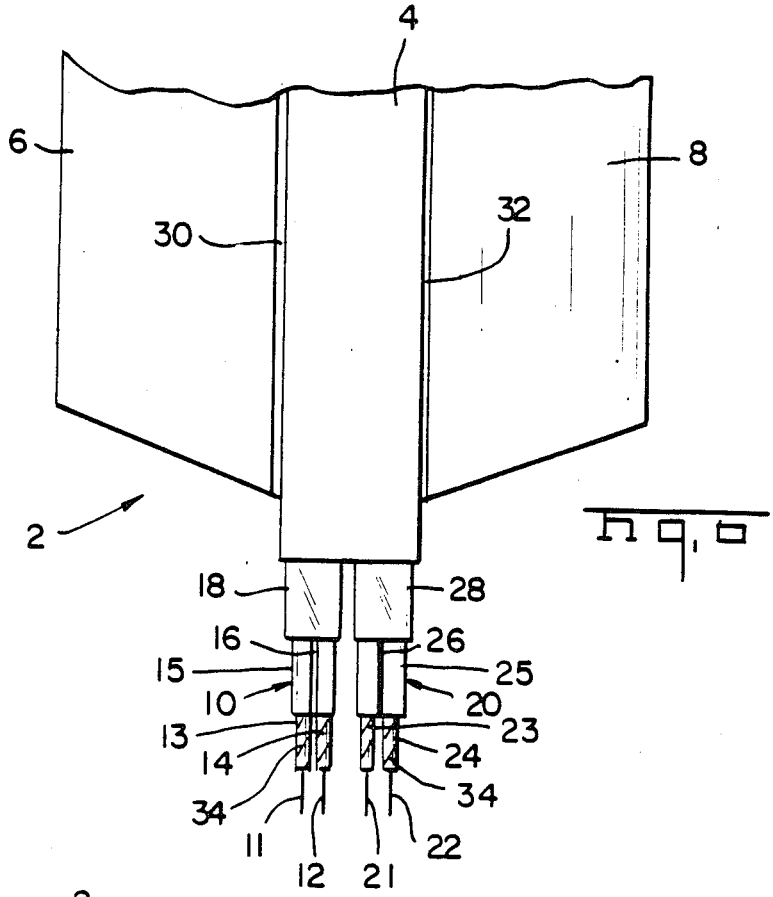
FIG. 6 is a plan view of a cable in accordance with the preferred embodiment of this invention showing the removal of respective layers of insulation from the four conductors comprising two conductor pairs.
Figure 7:
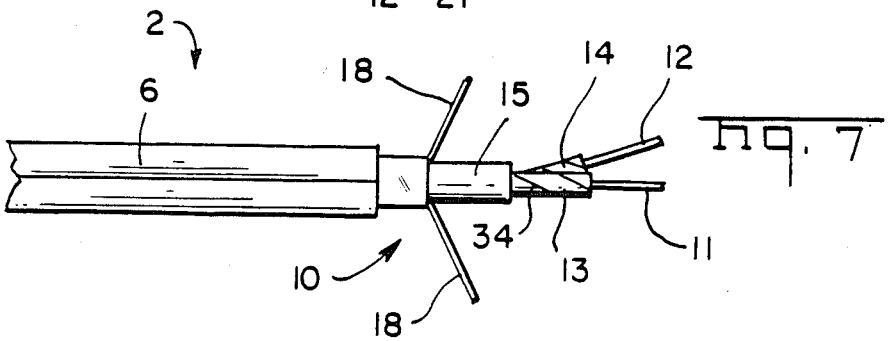
FIG. 7 is an elevational view of the cable as shown in FIG. 6 in which successive layers of the composite structure are shown adjacent one end of the cable.
Figure 6:
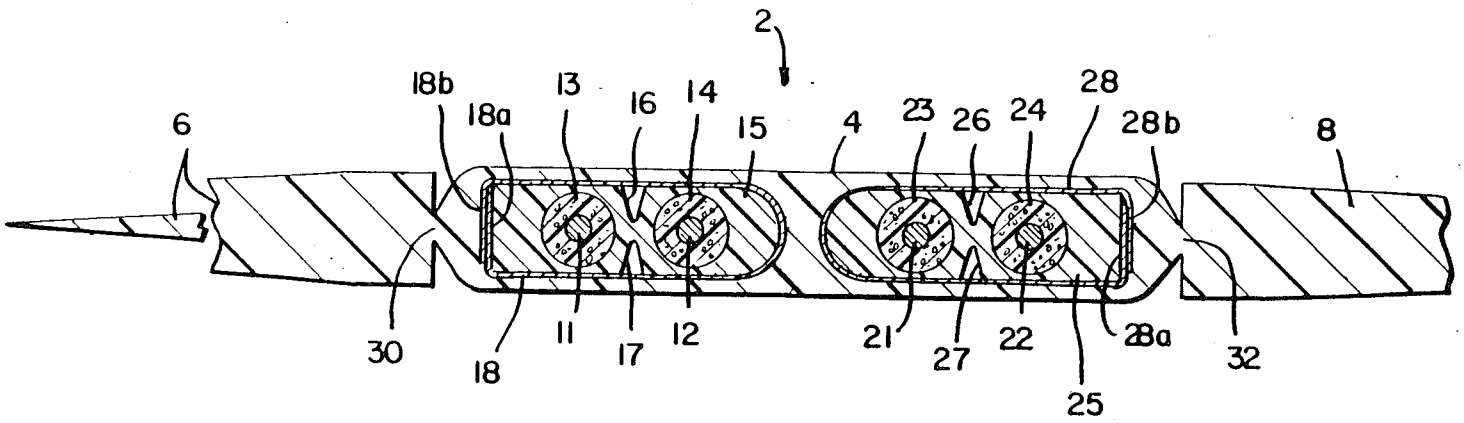

Not only is this cable suitable for use in applications in which high electrical performance is required, this cable is also easily adaptable to termination of the separate conductors to an electrical connector at the end of the cable. FIGS. 6 and 7 illustrate the ease in which the conductors may be presented for termination. Initially the wings 6 and 8 can be removed adjacent the ends. Weakened sections 30 and 32 facilitate the preparation of the ends of the cable since the wings can be removed by simply tearing along the weakened sections 30 and 32. The insulating material comprising the insulated body 4 can then be removed from the shielded cable pairs. The use of annealed copper foil, to which the insulating material forming the body 4 does not adhere permits the simple removal of this insulating material from the two conductor pairs. The shields 18 and 28 can then be cut and bent away from the extruded insulating core 15 and 25. The extruded insulating material forming core 25 can in turn be simply removed from the foam insulation surrounding conductors 21 and 22, since the foam insulation 23 and 24 does readily adhere to the extruded insulating material forming core 25. At this point the conductors 21 and 22 within foam insulation 23 and 24 are suitable for solderless mass termination by conventional insulation displacement techniques. Both FIGS. 6 and 7 however show the conductors 21 and 22 extending beyond the foam insulation 23 and 24. It should be appreciated that conductors 21 and 22 are shown primarily for illustrative purposes since it will normally not be necessary to remove insulation 23 and 24 from the bare conductors 21 and 22. However it may be desirable in certain installations to remove the insulation 23 and 24 before terminating conductors 21 and 22 and this invention is suitable for use in this matter.

Although the invention has been described in terms of two embodiments and additional extensions of this invention have been discussed, it will be appreciated that the invention is not limited to the precise embodiments disclosed or discussed since other embodiments will be readily apparent to those skilled in the art.

We claim:

1. A multi conductor flat cable comprising a plurality of balanced pairs of associated conductors for transmitting high frequency signals, the cable exhibiting high impedance, low cross talk electrical performance, the conductors being spaced side-by-side in the same plane and being separable at either end of the cable for individual termination, each individual conductor being separately surrounded by a first insulating medium, each conductor pair being in turn encapsulated within a second insulating medium in a predetermined dimensional configuration, the first insulating medium having a dielectric constant lower than the dielectric constant of the second insulating medium, a conductive shield surrouding the second insulating medium surrounding each conductor pair forming a continuous EMI shield around each conductor pair, and a third insulating medium surrounding the plurality of conductive pairs, the conductive shields being encapsulated in the third insulating medium.

2. The cable of claim 1 wherein each first insulating medium encircles each conductor.

3. The cable of claim 2 wherein the first insulating medium comprises a foam material containing air to decrease the dielectric constant.

4. The cable of claim 3 wherein the first insulating medium comprises 40 to 60 percent air.

5. The cable of claim 1 wherein the second and third insulating mediums comprise extruded insulating mediums.

6. The cable of claim 1 wherein each conductive shield surrounding each pair of associated conductors comprises a metal foil shield.

7. The cable of claim 6 wherein the ends of each metal foil shield are positioned in overlapping relationship.

8. The cable of claim 7 wherein each metal foil shield comprises an annealed copper foil.

9. The cable of claim 7 wherein the third insulating medium is extruded around each metal foil shield to retain the ends of the metal foil shield in overlapping relationship.

10. The cable of claim 1 wherein all of the individual conductors are located in the same plane.

11. A controlled high impedance, low cross talk, low attenuation multiconductor flat data cable comprising a plurality of balanced pairs of associated conductors having the electrical performance of shielded twisted pair cable for use in undercarpet installations, the cable comprising:

a plurality of conductors spaced side by side in the same plane and subdivided into associated conductor pairs;

a foam insulation surrounding each conductor and having air dispersed therein to reduce the dielectric constant of the foam insulation, the foam insulation being located in areas of relatively high electric fields;

a plurality of separate extruded insulating cores, each extruded insulating core in turn surrounding the foam insulated conductors of each associated pair, each extruded insulating core imparting dimensional stability to retain the conductors of each associated pair on the prescribed spacing and having a greater compressive strength than the foam insulation, the foam insulated conductors being separable from the extruded insulating cores for individual termination;

a separate EMI shield surrounding each extruded insulating core and each pair of associated conductors; and an outer extruded insulating body, surrounding each EMI shield, the pairs of associated conductors being embedded in the insulating body.

12. The cable of claim 11 wherein the insulating core has one planar edge extending transverse to the common plane of the conductors.

13. The cable of claim 12 wherein the ends of each EMI shield are positioned in mutual overlapping relationship along the transverse planar edge of the insulating core.

14. The cable of claim 13 wherein each EMI shield comprises an annealed metallic foil.

15. The cable of claim 11 further comprising inclined ramps joined on opposite sides of the insulating body by a weakened section.

16. The cable of claim 11 wherein the material forming each insulating core does not adhere to the foam insulation which it surrounds.

17. The cable of claim 12 wherein longitudinally extending notches are defined into opposite surfaces of each insulating core between and parallel to the conductors forming each associated pair to form a longitudinally extending weakened section in each core.

18. A high impedance, low cross-talk cable for use in transmitting high frequency signals comprising a plurality of signal conductors, spaced side by side in the same plane, each signal conductor being separately surrounded by first insulating material, a second insulating material surrounding the first insulating material, the dielectric constant of the first insulating material being less than the dielectric constant of the second insulating material, the second insulating material imparting dimensional stability to the signal conductors, the second insulating material individually surrounding each signal conductor and the first insulating material therearound, the second insulating material comprising means for holding the signal conductors in parallel configuration along precisely spaced centerlines, an EMI shield surrounding the second insulating material, and a third insulating material, the EMI shield being encapsulated in the third insulating material.

* * * * *